US006933681B2

(12) United States Patent
Rudolph

(10) Patent No.: US 6,933,681 B2
(45) Date of Patent: Aug. 23, 2005

(54) CIRCUIT ARRANGEMENT AND METHOD FOR STARTING AND OPERATING DISCHARGE LAMPS

(75) Inventor: Bernd Rudolph, Forstern (DE)

(73) Assignee: Patent Treuhand Gesellschaft fur elektrische Gluhlampen mbH, Munich (DE)

( * ) Notice: Subject to any disclaimer, the term of this patent is extended or adjusted under 35 U.S.C. 154(b) by 30 days.

(21) Appl. No.: 10/762,461

(22) Filed: Jan. 23, 2004

(65) Prior Publication Data

US 2004/0150349 A1 Aug. 5, 2004

(30) Foreign Application Priority Data

Jan. 28, 2003 (DE) ..... 103 03 276

(51) Int. Cl.[7] ..... H05B 37/00

(52) U.S. Cl. ..... 315/219; 315/307; 315/308; 315/DIG. 5; 315/DIG. 7

(58) Field of Search ..... 315/219, 307, 315/308, DIG. 5, DIG. 7

(56) References Cited

U.S. PATENT DOCUMENTS 5,404,082 A 4/1995 Hernandez et al. ..... 315/219
5,410,221 A 4/1995 Mattas et al. ..... 315/307
5,604,411 A * 2/1997 Venkitasubrahmanian et al. ..... 315/307
5,612,597 A * 3/1997 Wood ..... 315/293

FOREIGN PATENT DOCUMENTS

EP 0 621 743 10/1994

OTHER PUBLICATIONS

Jinrong Qian et al., "Analysis, Design and Experiments of a High–Power–Factor Electronic Ballast", *IEEE Transaction on Industry Applications*, vol. 34, No. 3, May/Jun. 1998.

Jinrong Qian et al., "New Continuous–Input Current Charge Pump Power–Factor–Correction Electronic Ballast", *IEEE Transaction on Industry Applications*, vol. 35, No. 2, Mar./Apr. 1999.

* cited by examiner

*Primary Examiner*—David Vu

(57) ABSTRACT

In the case of circuit arrangements for operating discharge lamps (Lp1, Lp2) which include a charge pump for reducing line current harmonics, an energy imbalance occurs when the lamps are started. In order for this not to lead to components being destroyed, but for sufficient ignition voltage nevertheless to be generated at the lamps (Lp1, Lp2), a threshold switch (MOV, TH) monitors the frequency of an inverter included in the circuit arrangement.

19 Claims, 2 Drawing Sheets

CIRCUIT ARRANGEMENT AND METHOD FOR STARTING AND OPERATING DISCHARGE LAMPS

FIELD OF THE INVENTION

The invention relates to circuit arrangements for operating discharge lamps. In particular so-called charge pumps for reducing line current harmonics are applied.

BACKGROUND OF THE INVENTION

Circuit arrangements for starting and operating discharge lamps are used in electronic operating devices for discharge lamps. The starting of the discharge lamp is understood hereafter as meaning at least the ignition during an igniting phase. However, this may also be preceded by a preheating of electrode filaments during a preheating phase of the igniting phase. If the operating devices are operated on a line voltage, they have to conform to relevant regulations with respect to line current harmonics, for example IEC 1000-3-2. To ensure compliance with these regulations, circuit measures are necessary for reducing line current harmonics. Such a measure is the installation of so-called charge pumps. The advantage of charge pumps is the low level of circuit complexity necessary to realize them.

Circuit arrangements for operating discharge lamps which are operated on a line voltage generally include the following elements:

- a rectifier for rectifying the line voltage
- a main energy store
- an inverter, which draws energy from the main energy store and produces at an inverter output an inverter voltage which has an inverter frequency that is much higher than the line frequency
- a matching network, via which discharge lamps can be coupled to the inverter output.

If the main energy store is charged directly from the rectifier, this produces charge current peaks, which lead to infringement of said regulations.

The topology of a charge lamp comprises that the rectifier is coupled to the main energy store via an electronic pumping switch. As a result, a pumping node is produced between the rectifier and the electronic pumping switch. The pumping node is coupled to the inverter output via a pumping network. The pumping network may include components which can at the same time be assigned to the matching network. The principle of the charge pump is that, during a half-period of the inverter frequency, energy is drawn from the line voltage via the pumping node and buffer-stored in the pumping network. In the half-period of the inverter frequency which then follows, the buffer-stored energy is fed via the electronic pumping switch to the main energy store.

Accordingly, energy is drawn from the line voltage in time with the inverter frequency. The electronic operating device generally includes filter circuits, which suppress spectral components of the line current lying at or above the inverter frequency. The charge pump may be designed in such a way that the harmonics of the line current are low enough to comply with said regulations. The following documents provide a detailed description of charge pumps for electronic operating devices for discharge lamps:

Qian J., Lee F. C., Yamauchi, T.: "Analysis, Design and Experiments of a High-Power-Factor Electronic Ballast", IEEE Transactions on Industry Applications, Vol. 34, No. 3, May/June 1998

Qian J., Lee F. C., Yamauchi, T.: "New Continuous Current Charge Pump Power-Factor-Correction Electronic Ballast", IEEE Transactions on Industry Applications, Vol. 35, No. 2, March/April 1999.

In the document EP 0 621 743 (Mattas) there is a description of a circuit arrangement for operating a discharge lamp which includes a charge pump. It additionally has a controller which brings about a modulation of the inverter frequency with twice the line frequency. This achieves the object of improving the crest factor of the lamp current that is applied to the discharge lamp. The service life of the lamps is consequently increased.

The aforementioned matching network includes a resonant circuit, which essentially includes a resonant capacitor and a lamp inductor. The resonant circuit has a resonant frequency, which, without damping of the resonant circuit, lies at a natural frequency of the resonant circuit.

For igniting the discharge lamp, the inverter is initially operated at an inverter frequency that lies above the natural frequency. In an igniting phase, the inverter frequency is lowered until it is close to the natural frequency of the resonant circuit, generates a high voltage at the discharge lamp and ignites the discharge lamp.

In this case, the following problem occurs: before the igniting of the discharge lamp, on the one hand there is no significant energy consumer in the circuit arrangement. On the other hand, the charge pump is operating and constantly depositing energy in the main energy store. This produces an imbalance between the energy received by the circuit arrangement and the energy delivered by it. If the discharge lamp does not ignite promptly, this leads either to the main energy store being destroyed or to the circuit arrangement being switched off, if switching-off means are provided for this purpose.

In the prior art, this leads to an optimization problem for the choice of the inverter frequency during the igniting phase: On the one hand, the time in which said energy imbalance prevails is to be short. This achieves a high ignition voltage, which demands an inverter frequency close to the natural frequency. On the other hand, the energy imbalance is to be as small as possible, in order that the time to overloading of the main energy store, and consequently the igniting phase, can be as long as possible. This is desirable for reliable ignition of the discharge lamp, but demands an inverter frequency that lies as far as possible above the natural frequency. The optimizing task is made more difficult by the fact that external circumstances, such as for example the igniting properties of the discharge lamp, ambient temperature and component tolerances, have an influence on it.

In the prior art, there are two solutions to the problem: either unreliable ignition of the discharge lamp is accepted, or components such as the main energy store and lamp inductor are overdimensioned, and consequently become expensive and bulky.

SUMMARY OF THE INVENTION

It is an object of the present invention to provide a circuit arrangement for starting and operating discharge lamps. The circuit arrangement has the following features:

- A first and a second line terminal for the connection of a line voltage,
- a rectifier, the rectifier input of which is coupled to the line terminals and at the rectifier output of which the rectified line voltage is present,
- the rectifier output is coupled to an electronic pumping switch, with the effect of forming a first pumping node at the electronic pumping switch, the side of the electronic pumping switch facing away from the rectifier output is coupled to a main energy store, the main energy store supplies energy to an inverter, which produces at an inverter output an inverter voltage which has an inverter frequency that is much higher than the frequency of the line voltage, the inverter output is coupled to the first pumping node via a pumping network, discharge lamps can be connected to the inverter output via a matching network, which has a resonant circuit with a natural frequency, a controller, the controller output of which outputs an actuating signal, the controller output being coupled to the inverter in such a way that the actuating signal influences the inverter frequency, and a first controller input, into which there is fed a first electrical variable, which corresponds to a first operating variable.

The circuit arrangement should accomplish a reliable and low-cost ignition of the lamp.

This object is achieved by a circuit arrangement described above with the following features:

The controller has a second controller input, into which there is fed via a threshold switch, a second electrical variable, which corresponds to a second operating variable, which is a measure of the reactive energy that resonates in the resonant circuit, the value of the second electrical variable bringing about a greater value of the inverter frequency if the threshold value of the threshold switch is exceeded.

In the prior art of EP 0 621 743 (Mattas) there is a description of a controller which has a first controller input. An electrical variable which corresponds to a first operating variable of a discharge lamp operated on lamp terminals is fed to this first controller input.

According to the invention, the controller has a second controller input. A second electrical variable, which corresponds to a second operating variable which is a measure of the reactive energy that resonates in the resonant circuit is fed to the second controller input. According to the invention, the second electrical variable is fed to the second controller input via a threshold switch. In the event that the value of the second electrical variable exceeds the threshold value of the threshold switch, the inverter frequency is increased.

By choosing the threshold value and the frequency increase, it is possible to set the maximum energy imbalance in the charge pump. According to the invention, a maximum ignition voltage can consequently be achieved along with optimum use of the components. Consequently, reliable ignition of discharge lamps is possible even with low-cost components.

BRIEF DESCRIPTION OF THE DRAWINGS

The invention is to be explained in more detail below on the basis of exemplary embodiments with reference to drawings, in which.

In the text which follows, resistors are denoted by the letter R, transistors by the letter T, coils by the letter L, amplifiers by the letter A, diodes by the letter D, node potentials by the letter N and capacitors by the letter C, in each case followed by a number. The same designations are also used throughout in the text which follows for elements of the various exemplary embodiments that are the same and for elements that have the same effect.

DETAILED DESCRIPTION OF THE INVENTION

Figure 1:
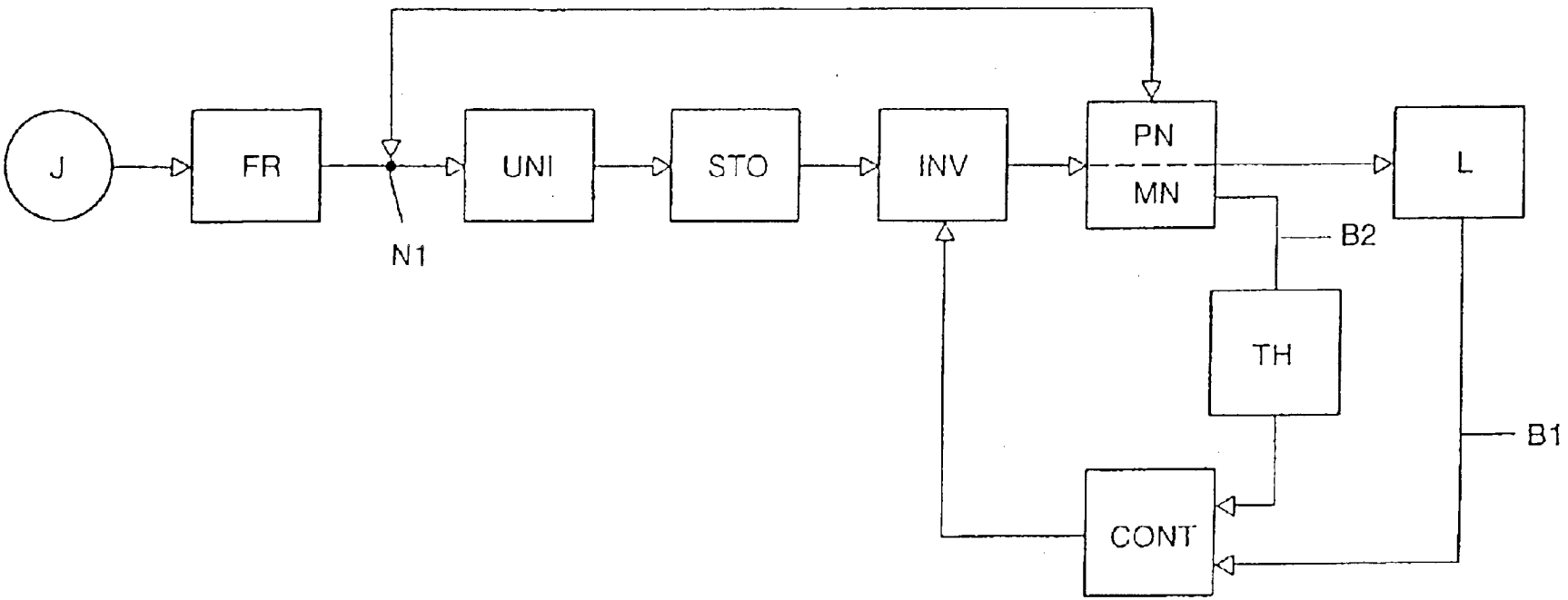
FIG. 1 shows a block diagram for a circuit arrangement according to the invention for starting and operating discharge lamps.

Represented in FIG. 1 is a block diagram for a circuit arrangement according to the invention for starting and operating discharge lamps. At connection terminals J, a line voltage from a line voltage source can be fed to the circuit arrangement. The line voltage is initially fed into a block FR. On the one hand, this block includes known means for filtering disturbances. On the other hand, this block includes a rectifier, which rectifiers the line voltage, which is an AC voltage. Usually, a bridge-connected full-wave rectifier is used for this purpose. Important for the function of a charge pump realized in the circuit arrangement is the property of the rectifier that it does not permit any current that allows an energy flow from the circuit arrangement to the line voltage source.

The rectified line voltage is fed to an electronic pumping switch UNI, a pumping node N1 being produced at the connecting point between the rectifier FR and the electronic pumping switch UNI. In the simplest case, the electronic pumping switch UNI comprises a pumping diode, which only allows a current flow that flows from the pumping node N1 to the pumping diode. It is also possible, however, to use any desired electronic switch, such as for example a MOSFET, for the electronic pumping switch UNI that performs the function of the pumping diode.

The current which the electronic pumping switch UNI allows through feeds a main energy store STO. The main energy store STO is usually configured as an electrolytic capacitor. However, other types of capacitors are also possible. In principle, the dual form of energy storage with respect to the capacitor is also possible. In the dual case, the main energy store STO is configured as a coil. Because of the lower costs and the better efficiency, a capacitor is preferred as the main energy store STO.

Figure 2:
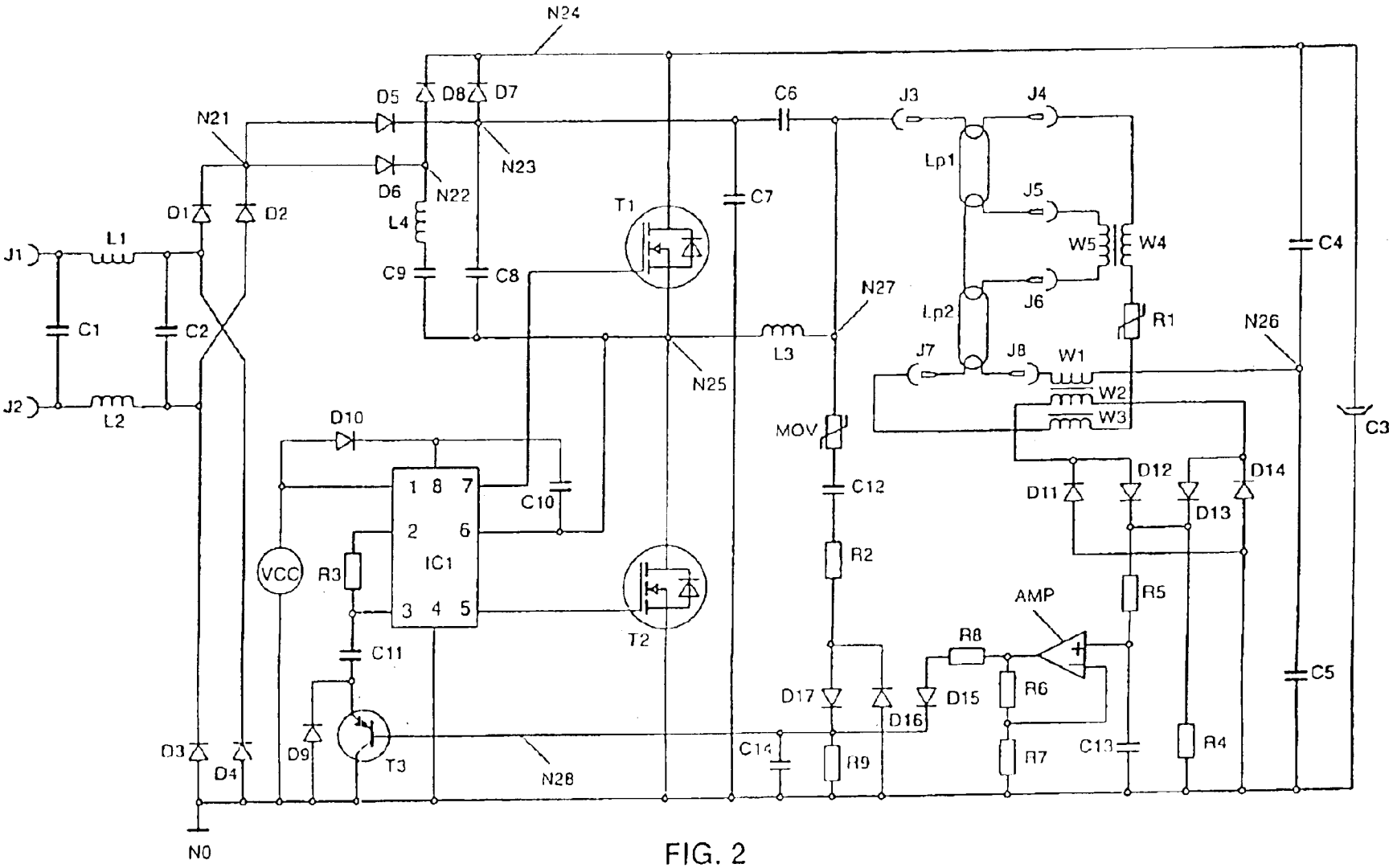
FIG. 2 shows an exemplary embodiment of a circuit arrangement according to the invention for starting and operating discharge lamps.

There are also configurations of charge pumps with a number of so-called pumping branches. In this case, a number of electronic pumping switches UNI are connected in parallel. This produces a number of pumping nodes N1. For the mutual decoupling of the pumping nodes, a diode is connected in each case between the rectifier and the pumping node. An exemplary embodiment with two pumping branches is represented in FIG. 2.

The main energy store STO provides its energy to an inverter INV. The inverter INV generates an alternating variable, usually an AC voltage, which is fed to a block, which is designated by MN and PN. MN designates the function of the block as a matching network. With respect to this function, the block MN/PN can be connected to a discharge lamp L. PN designates the function of the block as a pumping network. With respect to this function, the block MN/PN is connected to the pumping node N1. The connecting line between the pumping node N1 and the block MN/PN is provided in FIG. 1 with an arrow at both ends. This is intended to indicate that energy flows in an alternating manner from the pumping node N1 to the block MN/PN and back. The functions of the matching network and of the pumping network are combined in the block MN/PN because embodiments of the invention in which individual components can be assigned both to one and the other function are possible.

A controller CONT, which uses a manipulated variable to act on the inverter INV, is provided for controlling a desired first operating variable. Consequently, a parameter of the alternating variable delivered by the inverter, for example the operating frequency or the pulse width, is changed in such a way that changing of the first operating variable is counteracted. The first operating variable is fed to a first input of the controller via the terminal B1. The first operating variable is a variable which determines the operation of the lamp. Therefore, in FIG. 1 the terminal B1 originates from the block for the discharge lamp L. The first operating variable is, for example, the lamp current or the lamp power. These variables to not have to be recorded directly on the discharge lamp L, but can also be taken from the block MN/PN.

According to the invention, the controller CONT has a second input. A second operating variable is fed to the second input via a threshold switch TH. According to the invention, the second operating variable is a measure of the reactive energy that resonates in a resonant circuit contained in the block MN/PN. The tapping of the second operating variable by means of the terminal B2 therefore takes place at the block MN/PN. It is also possible, however, to obtain a measure of said reactive energy from lamp operating variables, such as for example the lamp voltage.

For igniting the discharge lamp L, reactive energy is built up in the resonant circuit. The reactive energy provides information on the energy imbalance of the charge pump and the loading of components. If the second operating variable exceeds the threshold of the threshold switch, according to the invention the rectifier is influenced by the controller CONT in such a way that the reactive energy does not increase any further. This can take place by the operating frequency of the inverter INV being raised. The controller CONT may include an adder, which adds the signals present at the controller inputs. It must be ensured that the signal at the first controller input does not clamp the signal at the second controller input. If the signal at the second controller input exceeds the signal at the first controller input, the signal at the second controller input must be the decisive controller signal.

Represented in FIG. 2 is an exemplary embodiment of a circuit arrangement according to the invention for starting and operating discharge lamps.

A line voltage can be connected to the terminals J1 and J2. The line voltage is fed via a filter, comprising two capacitors C1, C2 and two coils L1, L2, to a full-bridge rectifier comprising the diodes D1, D2, D3, D4. The full-bridge rectifier provides the rectified line voltage at its positive output, a node N21, with respect to a reference node N0.

The rectified line voltage is fed via the diodes D5 and D6 to two pumping nodes N22 and N23. The exemplary embodiment in FIG. 2 accordingly has two pumping branches. The diodes D5 and D6 are necessary for decoupling the pumping branches from each other. When there is only one pumping branch, a pumping node can be connected directly to the rectifier output, the node N21. In this case, however, it must be ensured that the diodes used in the rectifier can switch quickly enough to follow the inverter frequency. If this is not the case, a high-speed diode must be connected between the rectifier output and the pumping nodes even when there is only one pumping branch. In the exemplary embodiment in FIG. 2, the pumping nodes are coupled to the positive output of the rectifier. Charge pump topologies in which pumping nodes are coupled to the negative output of the rectifier are also known from the literature.

Leading from the pumping nodes N22 and N23 to the node N24 there is respectively an electronic pumping switch, configured as diodes D7 and D8. Connected between N24 and N0 is the main energy store, which is configured as electrolytic capacitor C3.

C3 feeds the inverter, which is configured as a half bridge. Other converter topologies, such as for example a flyback converter or full bridge, can also be used, however. A half bridge is advantageously used for lamp powers of between 5 W and 300 W, since it represents the lowest-cost topology.

The half bridge essentially comprises a series connection of two half-bridge transistors T1 and T2 and a series connection of two coupling capacitors C4 and C5. Both series connections are connected in parallel with C3. A connecting node N25 of the half-bridge transistors and a connecting node N26 of the coupling capacitors form the inverter output at which a square-wave inverter voltage with an inverter frequency is present.

Connected between N25 and a lamp voltage node N27 is a lamp inductor L3. Connected at N27 is the terminal J3, at which the series connection of two discharge lamps Lp1 and Lp2 is connected in the exemplary embodiment. However, the present invention can also be configured with one or more lamps. The current through the discharge lamps Lp1 and Lp2 flows via a terminal J8, through a winding W1 of a measuring transformer to the node N26. Consequently, the inverter voltage is essentially applied to a series connection of two discharge lamps Lp1, Lp2 and the lamp inductor L3.

The current fed into J3 flows not only through the gas discharge of the discharge lamps Lp1, Lp2 but also through an outer filament of the first discharge lamp Lp1 to a terminal J4. From there, it continues through a winding W4 of a heating transformer, on through a variable resistor R1 and on through a winding W3 of the measuring transformer to the terminal J7. Connected to the terminal J7 is an outer filament of the second discharge lamp Lp2, the other end of which leads to the terminal J8. Two inner filaments of the discharge lamps Lp1 and Lp2 are respectively connected via the terminals J5 and J6 to the winding W5 of the heating transformer. By the arrangement described in this paragraph, the inverter voltage brings about not only a current through the gas discharge of the discharge lamps Lp1, Lp2 but also a heating current through the outer filaments and, via the heating transformer, also a heating current through the inner filaments of the discharge lamps Lp1, Lp2. If only one discharge lamp is to be operated, it is possible to dispense with the heating transformer.

The heating current is essentially required before the ignition of the discharge lamps Lp1, Lp2, during a preheating phase as a preheating current for the preheating of the filaments. The value of the heating current is determined largely by the variable resistor R1. During the preheating phase, the value of R1 is so low that a heating current prescribed by lamp data is achieved. After the preheating phase, the value of R1 increases, so that negligible heating current flows in comparison with the current through the gas discharge of the discharge lamps Lp1, Lp2. In the exemplary embodiment, R1 is realized by a so-called PTC or positive temperature coefficient thermistor. This is a resistor which in the cold state has a low resistance. The PTC thermistor is heated up by the heating current, making its resistance value increase. R1 may also be realized by an electronic switch which is closed in the preheating phase and then open. A resistor with a constant resistance value may be connected in series with the switch. Consequently, a rapid transition from the preheating phase to the igniting phase is possible.

The described arrangement for preheating the filaments has the effect that, during the preheating phase, the resonant frequency of a resonant circuit described in the next paragraph is lower than its natural frequency, due to damping. An inverter frequency which lies below the natural frequency is advantageously chosen during the preheating phase, in order to obtain a high heating current, and consequently a short preheating phase.

The lamp voltage node N27 is connected to the pumping node N23 via a first resonant capacitor C6. Connected between N23 and N0 is a second resonant capacitor C7. C6 and C7 form with the lamp inductor L3 a resonant circuit. For fixing the natural frequency of the resonant circuit, C6 and C7 are viewed as connected in series. The effective capacitance value of C6 and C7 with respect to the natural frequency is consequently the quotient of the product and the sum of the capacitance values of C6 and C7. If the resonant circuit is stimulated close to its natural frequency, an ignition voltage that leads to the ignition of the discharge lamps is produced across the lamps. After the ignition, L3 acts together with C6 and C7 as a matching network, which transforms an output impedance of the inverter into an impedance necessary for the operation of the discharge lamps.

The connection of C6 and C7 to the pumping node N23 has the effect, however, that the combination of L3, C6 and C7 acts not only as a resonant circuit and matching network but at the same time as a pumping network. If the potential at N23 is lower than the momentary line voltage, the pumping network L3, C6, C7 draws energy from the line voltage. If the potential at N23 exceeds the voltage at the main energy store C3, the energy accepted from the line voltage is delivered at C3. The choice of the ratio of the capacitance values of C6 and C7 allows the effect of the network L3, C6, C7 as a pumping network to be adjusted. The greater the capacitance value of C7 is chosen to be, the less the network L3, C6, C7 acts as a pumping network.

A further pumping effect is produced by a capacitor C8, which is connected between N23 and the connecting node N25 of the half-bridge transistors T1, T2. C8 also not only acts as a pumping network but at the same time performs the task of a snubber capacitor. Snubber capacitors are generally known as a measure for switch relief in inverters.

The pumping network for the second pumping branch comprises the series connection of a pumping inductor L4 and a pumping capacitor C9. This pumping network is connected between the connecting node N25 of the half-bridge transistors T1, T2 and the pumping node N22. In the case of the present exemplary embodiment, two pumping branches are used, in order that the pumped energy is divided between a number of components. Lower-cost dimensioning of the components is consequently possible. It also provides a degree of freedom in the design of the dependence of the pumped energy on operating parameters of the discharge lamps. However, the invention can also be realized with only one pumping branch.

The half-bridge transistors T1, T2 are designed as MOSFETs. Other electronic switches may also be used for this. For activating the gates of T1 and T2, an integrated circuit IC1 is provided in the exemplary embodiment. IC1 is in the present example a circuit of the type IR2153 from the company International Rectifier. Alternative circuits of this type are also available on the market; for example L6571 from the company STM. The circuit IR2153 includes a so-called high-side driver, with which the half-bridge transistor T1 can also be activated, although it has no connection at the reference potential N0. A diode D10 and a capacitor C10 are necessary for this purpose.

The operating voltage supply of the IC1 takes place via the terminal 1 of the IC1. In FIG. 2, a voltage source VCC is provided for this purpose between terminal 1 of the IC1 and N0. Several possible ways in which this voltage source VCC can be realized are generally known. In the simplest case, the IC can be supplied via a resistor from the rectified line voltage.

Apart from the driver circuits for the half-bridge transistors, IC1 includes an oscillator, the oscillating frequency of which can be set via the terminals 2 and 3. The oscillating frequency of the oscillator corresponds to the inverter frequency. Connected between the terminals 2 and 3 is a frequency-determining resistor R3. Connected between terminal 3 and N0 is the series connection of a frequency-determining capacitor C11 and the emitter-collector path of a bipolar transistor T3. Connected in parallel with the emitter-collector path of T3 is a diode D9, in order that C11 can be charged and discharged. The inverter frequency can be set by a voltage between the base terminal of T3 and N0 and consequently forms a manipulated variable for the control circuit. The base terminal of T3 is connected to a manipulated-variable node N28. T3, IC1 and their wiring can consequently be regarded as a controller.

The functions of the IC1 and its wiring can also be realized by any desired voltage-controlled or current-control oscillator which brings about the activation of the half-bridge transistors via driver circuits.

The control circuit in the exemplary embodiment records as a controlled variable the current through the gas discharge of the discharge lamps Lp1, Lp2. For this purpose, the measuring transformer has a winding W2. The winding direction in the measuring transformer is designed such that the heating current in the winding W3 is subtracted from an overall current in winding W1, so that in winding W2 there flows a current which is proportional to the current through the gas discharge of the discharge lamps Lp1, Lp2. A full-bridge rectifier, formed by diodes D11, D12, D13 and D14, rectifies the current through winding W2 and leads it via a low-resistance measuring resistor R4 to N0. The voltage drop across R4 is consequently a measure of the current through the gas discharge of the discharge lamps Lp1, Lp2. Passing via a low-pass filter for averaging, which is formed by a resistor R5 and a capacitor C13, the voltage drop across R4 reaches the input of a noninverting measuring amplifier.

The measuring amplifier is realized in a known way by an operational amplifier AMP and the resistors R6, R7 and R8. In the exemplary embodiment, a gain of the measuring amplifier of about 10 is set. In the event that the voltage drop across R4 has values which can be used directly as a manipulated variable, it is possible to dispense with the measuring amplifier or replace it with an impedance converter, such as for example an emitter follower.

The output of the measuring amplifier is connected via a diode D15 to the manipulated-variable node N28. Consequently, the control circuit for controlling the current through the gas discharge of the discharge lamps Lp1, Lp2 is closed. The diode D15 is necessary in order that the potential of N28 can be raised to a value that lies above the value prescribed by the measuring amplifier. The anode of D15 represents a first controller input.

The threshold switch according to the invention is realized in FIG. 2 by a varistor MOV. It lies in a series connection with a capacitor C12, a resistor R2 and a diode D17, which connects the voltage node N27 to the manipulated-variable node N28. The anode of D17 represents a second controller input. N28 is connected via the parallel connection of a resistor R9 and a capacitor C14 to N0.

At N27 there is with respect to N0 a voltage which is a measure of the reactive energy resonating in the resonant circuit, formed by L3, C6 and C7. If this voltage exceeds the threshold voltage of the varistor MOV, a current flows through R9, and C14 is charged. The voltage at the manipulated-variable node N28 is consequently raised. This brings about an increase in the inverter frequency, and the reactive energy resonating in the resonant circuit is reduced, since the inverter frequency shifts further away from the natural frequency of the resonant circuit.

Connected between N0 and the connecting point of R2 and D17 is the diode D16. Consequently, acting together with C12, the sum of the positive amplitude and negative amplitude of the voltage which the varistor MOV allows to pass is applied to N28. Instead of the varistor MOV, any other desired threshold switch may be used, such as can be constructed for example by Zener diodes or suppressor diodes. The threshold value of the varistor MOV is chosen in the application example as 250 Vrms. A higher value has the effect that more reactive energy is allowed in the resonant circuit, which leads to a higher ignition voltage at the discharge lamps Lp1, Lp2, but also leads to a greater loading of components. Consequently, a desired optimum can be set by means of the threshold value of the varistor MOV.

The value of the resistor R2 influences the intensity of the effect of the intervention according to the invention on the control circuit at the manipulated-variable node N28. A nonlinear relationship between the voltage at the manipulated-variable node N28 and the inverter frequency is also advantageous. This nonlinear relationship is realized in the application example by the nonlinear characteristic of T3. Moreover, it is influenced by the dependence of the frequency of the oscillator in the IC1 on the voltage at the terminal 3 of the IC1. Due to the nonlinearity, a strong increase in the voltage at N27 leads to a disproportionate increase in the inverter frequency, whereby overloading of components, such as for example the voltage loading of C3 or the current loading of T1 and T2, is prevented.

Instead of the voltage, the current in the resonant circuit could also be used as a measure of the reactive energy resonating in the resonant circuit. An additional winding on L3 could serve this purpose, for example.

What is claimed is:

1. A circuit arrangement for starting and operating discharge lamps (L, Lp1, Lp2), with the following features:

a first and a second line terminal (J1, J2) for the connection of a line voltage, a rectifier (D1, D2, D3, D4), the rectifier input of which is coupled to the line terminals and at the rectifier output (N21) of which the rectified line voltage is present, the rectifier output (N21) is coupled to an electronic pumping switch (UNI, D7, D8), with the effect of forming a first pumping node (N1, N23) at the electronic pumping switch (UNI, D7, D8), the side of the electronic pumping switch facing away from the rectifier output (N21) is coupled to a main energy store (C3), the main energy store (C3) supplies energy to an inverter (INV), which produces at an inverter output (N25, N26) an inverter voltage which has an inverter frequency that is much higher than the frequency of the line voltage, the inverter output (N25) is coupled to the first pumping node (N1, N23) via a pumping network (PN, L3, C6, C7), discharge lamps (L, Lp1, Lp2) can be connected to the inverter output (N25) via a matching network (MN, L3, C6, C7), which has a resonant circuit (L3, CE, C7) with a natural frequency, a controller (CONT), the controller output of which outputs an actuating signal, the controller output being coupled to the inverter (INV) in such a way that the actuating signal influences the inverter frequency, a first controller input (B1), into which there is fed a first electrical variable, which corresponds to a first operating variable, a second controller input, into which there is fed via a threshold switch (TH, MOV), a second electrical variable, which corresponds to a second operating variable (B2), which is a measure of the reactive energy that resonates in the resonant circuit (L3, C6, C7), the value of the second electrical variable bringing about a greater value of the inverter frequency if the threshold value of the threshold switch (TH, MOV) is exceeded.

2. The circuit arrangement as claimed in claim 1, wherein the controller includes an adder, which adds the electrical variables from the first and second controller inputs.

3. The circuit arrangement as claimed in claim 1, wherein the electronic pumping switch (UNI) is realized by a first pumping diode (D7), which is polarized in such a way that energy can be fed via the first pumping diode (D7) to the main energy store (C3).

4. The circuit arrangement as claimed in claim 3, wherein the rectifier output (N21) is connected via a second pumping diode (D5) to the first pumping node (N23), the second pumping diode (D5) being polarized in such a way that energy can be drawn from the rectifier via the second pumping diode.

5. The circuit arrangement as claimed in claim 4, wherein the rectifier output (N21) is coupled via the series connection of a third pumping diode (D6) and a fourth pumping diode (D8) to the main energy store (C3), with the effect of forming at the connecting point of the third pumping diode (D6) and the fourth pumping diode (D8) a second pumping node (N22), into which part of the energy which the rectifier output (N25) delivers is fed.

6. The circuit arrangement as claimed in claim 1, wherein the first pumping node (N23) or the second pumping (N22) is connected via a series connection of a pumping inductor (L4) and a pumping capacitor (C9) to the inverter output (N25).

7. The circuit arrangement as claimed in claim 1, wherein the inverter output (N25) is connected via a lamp inductor (L3) to a terminal (J3) for a discharge lamp (Lp1), with the effect of forming at this terminal a lamp voltage node (N27), which is connected via a resonant capacitor (C6) to the first pumping node (N23) or the second pumping node (N22).

8. The circuit arrangement as claimed in claim 1, wherein the current is fed through a discharge lamp into the first or the second pumping node.

9. The circuit arrangement as claimed in claim 1, wherein the inverter output (N25) is connected via a lamp inductor (L3) to a terminal for a discharge lamp (J3), with the effect of forming at this terminal a lamp voltage node (N27), at which the second electrical operating variable (B2) is tapped.

10. The circuit arrangement as claimed in claim 9, wherein the threshold switch (TH) is realized by a varistor (MOV) and is connected in series with a capacitor (C12) and a resistor (R2).

11. The circuit arrangement as claimed in claim 1, wherein the first operating variable (B1) is the current through an operated discharge lamps (Lp1, Lp2).

12. The circuit arrangement as claimed in claim 11, wherein a variable resistor (R1) closes a heating circuit, which brings about a heating current, driven by the inverter voltage, through electrode filaments of a connected discharge lamp (Lp1, Lp2).

13. The circuit arrangement as claimed in claim 12, wherein the variable resistor (R1) is a PTC thermistor.

14. The circuit arrangement as claimed in claim 12, wherein the variable resistor (R1) is an electronic switch.

15. The circuit arrangement as claimed in claim 1, wherein the controller has a nonlinear characteristic.

16. A method for starting and operating discharge lamps with a circuit arrangement as claimed in claim 1, characterized by the following steps:

damping the resonant circuit (L3, C6, C7) via filaments of connected discharge lamps, setting an inverter frequency that lies below the natural frequency, removal of the damping of the resonant circuit, recording of the second operating variable (B2), comparison of the second operating variable (B2) with a prescribed threshold value, increasing the inverter frequency in the event that the second operating variable (B2) exceeds the threshold value.

17. The circuit arrangement as claimed in claim 5, wherein the first pumping node (N23) or the second pumping node (N22) is connected via a series connection of a pumping inductor (L4) and a pumping capacitor (C9) to the inverter output (N25).

18. The circuit arrangement as claimed in claim 5, wherein the inverter output (N25) is connected via a lamp inductor (L3) to a terminal (J3) for a discharge lamp (Lp1), with the effect of forming at this terminal a lamp voltage node (N27), which is connected via a resonant capacitor (C6) to the first pumping node (N23) or the second pumping node (N22).

19. The circuit arrangement as claimed in claim 5, wherein the current is fed through a discharge lamp into the first or the second pumping node.

* * * * *